US006971921B1

(12) United States Patent
Lai

(10) Patent No.: US 6,971,921 B1
(45) Date of Patent: Dec. 6, 2005

(54) OPEN/CLOSE TYPE ELECTRICAL CONNECTOR

(75) Inventor: Ming Chun Lai, Tucheng (TW)

(73) Assignee: Cheng Uei Precision Industry Co., Ltd., Taipei (TW)

( * ) Notice: Subject to any disclaimer, the term of this patent is extended or adjusted under 35 U.S.C. 154(b) by 0 days.

(21) Appl. No.: 10/923,895

(22) Filed: Aug. 24, 2004

(51) Int. Cl.[7] ..... H01R 24/00
(52) U.S. Cl. ..... 439/676; 439/144
(58) Field of Search ..... 439/676, 144, 439/946, 334

(56) References Cited

U.S. PATENT DOCUMENTS 5,338,210 A * 8/1994 Beckham et al. ..... 439/131
5,679,023 A * 10/1997 Anderson et al. ..... 439/502
5,871,364 A * 2/1999 Shinchi et al. ..... 439/144
6,536,955 B2 * 3/2003 Ohbayashi et al. ..... 385/78

* cited by examiner

*Primary Examiner*—Phuong Dinh
(74) *Attorney, Agent, or Firm*—Rosenberg, Klein & Lee

(57) ABSTRACT

The present invention provides an open/close type electrical connector comprising, a base member, a terminal modular member positioned in the base member, and a cover member positioned on the base member. The cover member pivotally connects with the rear portion of the base member and rotates between an open position and a close position. When the cover member is opened, a receiving space is formed between the base member and the cover member to receive a mated plug. A restricting mechanism is further disposed at a lateral side of the base member for restricting an opened angle of the cover member with respect to the base member. An automatic close mechanism is disposed between the base member and the restricting mechanism so as to close the cover member automatically. Therefore, the open/close type electrical connector is capable of being closed to be a small and thin member automatically and without any accessorial operation by users when not used.

11 Claims, 8 Drawing Sheets

OPEN/CLOSE TYPE ELECTRICAL CONNECTOR

BACKGROUND OF THE INVENTION

1. Field of the Invention

The present invention relates generally to an open/close type electrical connector, and more especially to an electrical connector with an upper cover to provide an insert manipulation when opened, and an automatic close while not used.

2. The Related Art

With the fast development of the electronic technology, a variety of electronic devices are designed to be small size and strong function to provide convenience for users, such as portable computers, personal digital assistants, facsimiles and the like. All these devices usually need transmission lines to transmit power, data and other electrical signals to and from the receiving or storage devices thereof. So standard electrical connectors are widely used to assemble with the receiving or storage devices for transmitting signals. Referring to FIG. 8, a computer memory card 100 (PCMCIA card) is mainly used for communication connection between a portable computer and an Ethernet Local Area Network (LAN). Therefore, a standard RJ series electrical connector 10*a*, such as RJ11 or RJ45, is disposed at a lateral side of the computer memory card 100 and electrically connected with the computer memory card 100. As assembling, the electrical connector 10*a* connects with one end of a communication plug, while the other end of the communication plug connects with the Ethernet LAN, so that data transmission can be achieved between the portable computer and the Ethernet LAN via the computer memory card 100.

Generally speaking, the standard RJ series electrical connector 10*a*, as described above, has some problems below. Firstly, because the electrical connector 10*a* has a standardized size in height much more than the thickness of the common computer memory card 100 as shown in FIG. 8, the overall size of the computer memory card assembly mated with such electrical connector 10*a* tends to be bulky and makes it rather difficult to carry. Furthermore, due to the large size of the electrical connector 10*a*, the installation position of the assembly in the portable computer is largely limited. In addition, the contacting port of the electrical connector 10*a* is exposed outwards, and thus it is inevitable for the dust and dirt to be attached on contacting terminals so as to lead bad electrical contacting.

For improving the problems described above, U.S. Pat. No. 5,679,013 discloses an open/close type electrical connector. In the patent, the open/close type electrical connector comprises: a base member having an upper face defining an aperture; a cover member for opening and closing the aperture of the base member; a receiving face, disposed in the base member, for receiving a counter electrical connector having a rectangular parallelepiped shape; a terminal member, disposed in the base member, for being elastically in contact with a terminal of the counter electrical connector, the cover member being pivotally supported by one end portion of the base member for rotation between an opened position and closed position, the cover member defining thereby an axis of rotation, the cover member and the receiving face of the base member forming an accommodating space for the counter electrical connector when the cover member is in its opened position, and the cover member and the receiving face sandwiching the counter electrical connector; an engagement mechanism engageable with an engagement portion of the counter electrical connector, thereby preventing the counter electrical connector from slipping out of the base member; and an open position restricting mechanism for restricting an open angle of the cover member defining a back face and the receiving face defining a supporting face which is substantially parallel to the back face of the cover member when the cover member is in its opened position.

Accordingly, the rear portion of the cover member of the open/close type electrical connector is pivotally connected with the base member. And thus, the cover member can be opened upwardly in an angle through the rotation of an axis to provide a plug-in manipulation for the counter electrical connector. However, it needs users to close the cover member to the base member by hand when the open/close type electrical connector not in use, and so brings inconvenience for users.

SUMMARY OF THE INVENTION

Thus, an object of the present invention is to provide an improved open/close type electrical connector comprising, a base member, a terminal modular member disposed in the base member, and a cover member disposed on the base member. The cover member pivotally connects with the rear portion of the base member, and rotates between an opened position and a closed position. When the cover member is opened, a receiving space is defined between the base member and the cover member to receive a mated modular plug. Furthermore, a restricting mechanism is disposed at a lateral side of the base member for restricting an opened angle of the cover member with respect to the base member. An automatic close mechanism is disposed between the base member and the restricting mechanism so as to close the cover member automatically. Therefore, the open/close type electrical connector of the present invention is capable of being closed to be a small thin member automatically and without any accessorial operation by users when not used. And it has a more compact structure and facilitates to be carried by users.

BRIEF DESCRIPTION OF THE DRAWINGS

An embodiment of the invention will now be described by way of example with reference to the attached drawings, for better understanding thereof to those skilled in the art, according to which.

DETAILED DESCRIPTION OF THE PREFERRED EMBODIMENT

Figure 1:
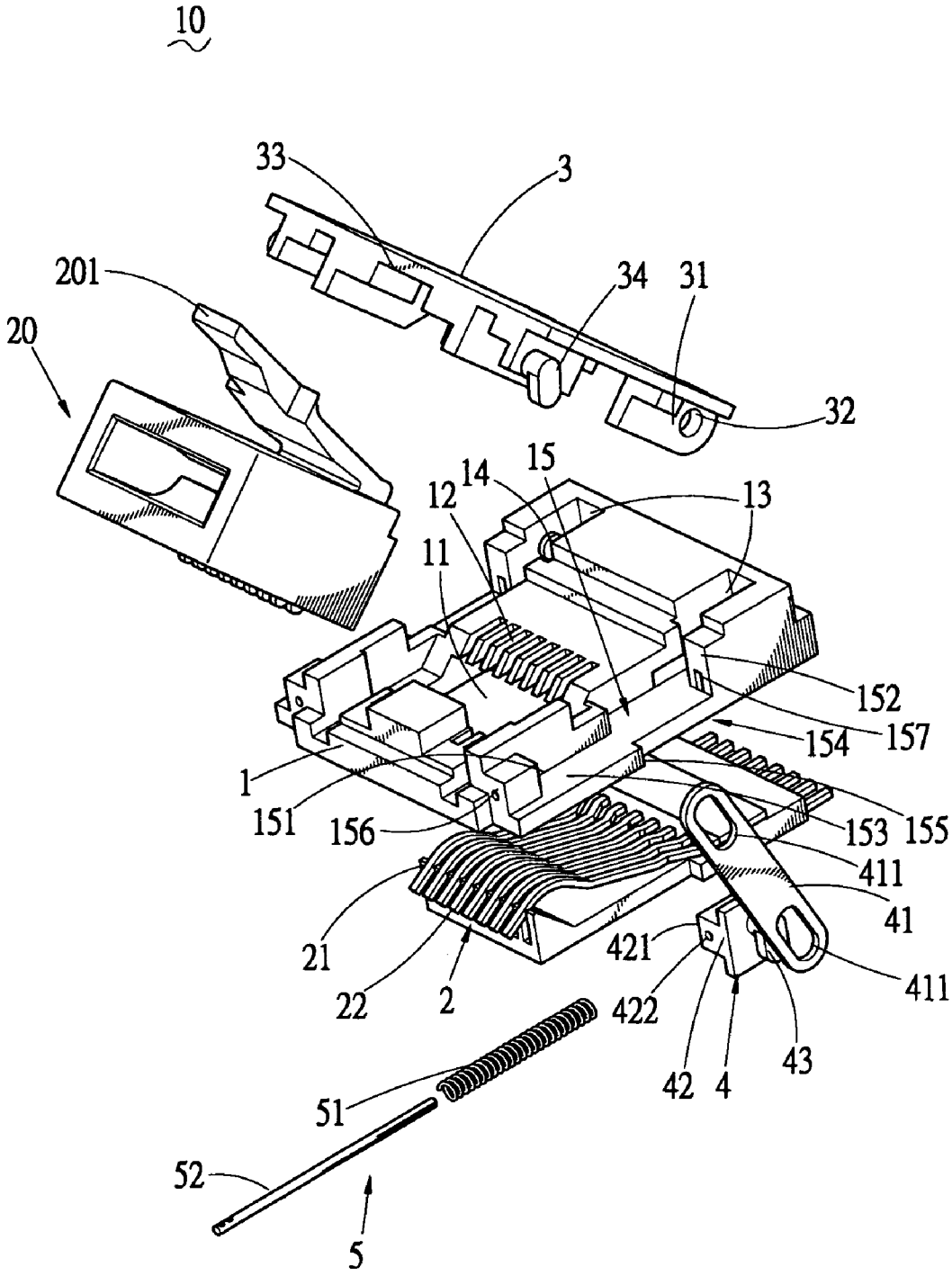
FIG. 1 is an exploded perspective view of an open/close type electrical connector according to the present invention.

With reference to FIG. 1, an open/close type electrical connector 10, in accordance with the preferred embodiment, is a RJ45 modular jack electrical connector. In the following description, the term "electrical connector" means an open/close type electrical connector. The electrical connector 10 is provided with a mated communication modular plug 20 to plug in for signal transmission. The electrical connector 10 comprises a base member 1. A receiving groove 11 is disposed in the base member 1. A plurality of terminal channels 12 is defined inside the receiving groove 11. Moreover, a terminal modular member 2 is disposed in the base member 1. The terminal modular member 2 comprises a plurality of contacting terminals 21 and a terminal receiving member 22. The contacting terminals 21 are insert-molded onto the terminal receiving member 22. The terminal receiving member 22 is installed in the base member 1, and the contacting terminals 21 are held respectively in the corresponding terminal channels 12.

Figure 4:
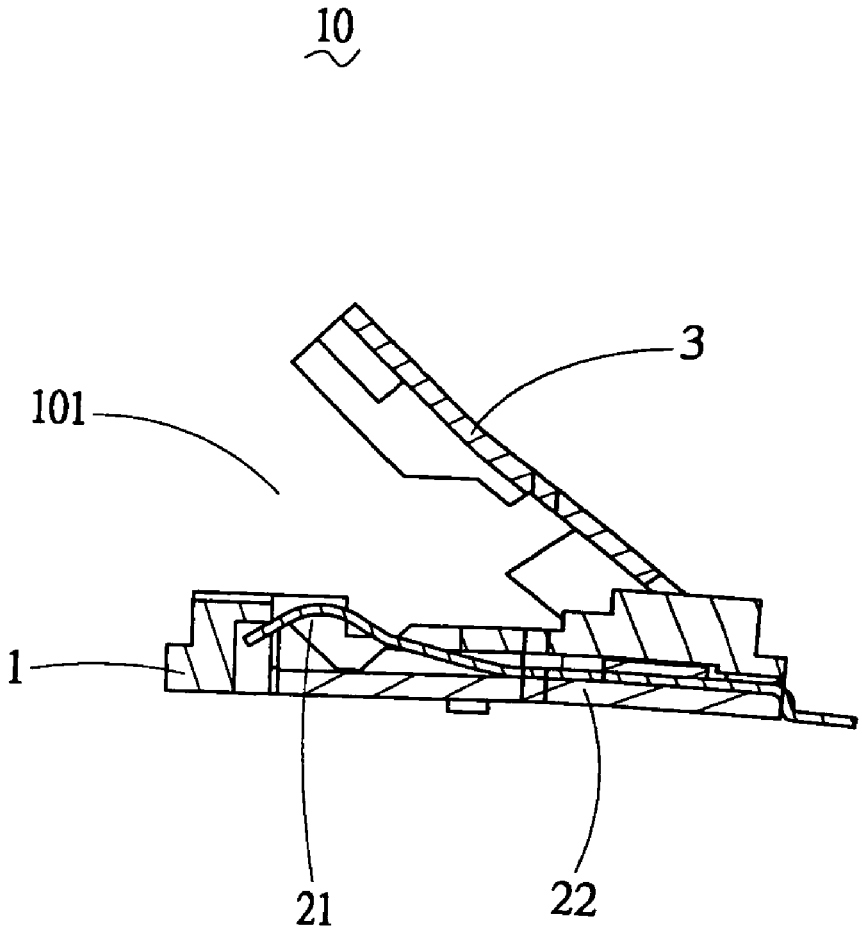
FIG. 4 is a cross-sectional view of the open/close type electrical connector as shown in FIG. 2.

According to the present invention, a cover member 3 is further disposed on the base member 1. The cover member 3 is provided with two protrusion members 31 protruding outwards from the rear portion thereof. Each protrusion member 31 further defines a pivot aperture 32 therein. Corresponding to each pivot aperture 32, a pivot groove 13 is defined in the rear portion of the base member 1. And a pivot axis 14 is disposed on one lateral wall of each pivot groove 13 for engaging with the corresponding pivot aperture 32. Therefore, the cover member 3 pivotally connects with the base member 1 by the connection of the pivot aperture 32 and the pivot axis 14 to make the cover member 3 open or close with respect to the base member 1. When the cover member 3 is opened, a receiving space 101 (as shown in FIG. 4) is formed between the cover member 3 and the base member 1 so as to receive the mated modular plug 20. According to the preferred embodiment, a slice 201 is disposed on top of the mated modular plug 20. An indentation groove 33 is correspondingly formed in the front portion of the cover member 3. While the mated modular plug 20 is inserted into the electrical connector 10, the slice 201 is fixed in the indentation groove 33 so as to latch the mated modular plug 20 to the electrical connector 10.

According to the present invention, a restricting mechanism 4 is disposed at a lateral side of the base member 1 for restricting an opened angle of the cover member 3 with respect to the base member 1. The restricting mechanism 4 comprises a connecting rod 41 and a sliding member 42. The connecting rod 41 defines two pivot cavities 411 respectively in both ends thereof. The sliding member 42 is disposed on the base member 1 and has a projection member 421 at the inside wall thereof. A through aperture 422 is defined in the projection member 421. The sliding member 42 has a protruding axis 43 projecting from the outside wall thereof, and correspondingly, the cover member 3 has a protruding axis 34 projecting from the lateral wall thereof. The two protruding axes 43, 34 are respectively held in the two pivot cavities 411 of the connecting rod 41. The base member 1 defines an elongated receiving member 15 at the lateral side thereof for supporting the sliding member 42 thereon. The receiving member 15 has a front wall 151 and a rear wall 152 disposed respectively at both ends thereof. The front wall 151 and rear wall 152 define respectively an axis aperture 156, 157. The outer side of the receiving member 15 protrudes to define a shoulder member 153 and a gap member 154, with a stop wall 155 formed between the shoulder member 153 and the gap member 154. Therefore, the projection member 421 of the sliding member 42 is limited to move between the rear wall 152 and the stop wall 155.

An automatic close mechanism 5, according to the present invention, is further disposed between the base member 1 and the restricting mechanism 4. The automatic close mechanism 5 comprises an elastic mechanism 51, and an axis rod 52 passing through and located in the elastic mechanism 51. The axis rod 52 further passes through the through aperture 422 of the sliding member 42, and the two ends of the axis rod 52 are respectively held in the axes apertures 156, 157 of the receiving member 15. Therefore, one end of the elastic mechanism 51 withstands the front wall 151 of the receiving member 15, and the other end thereof withstands the projection member 421 of the sliding member 42. According to the preferred embodiment, the elastic mechanism 51 is a spring.

Figure 2:
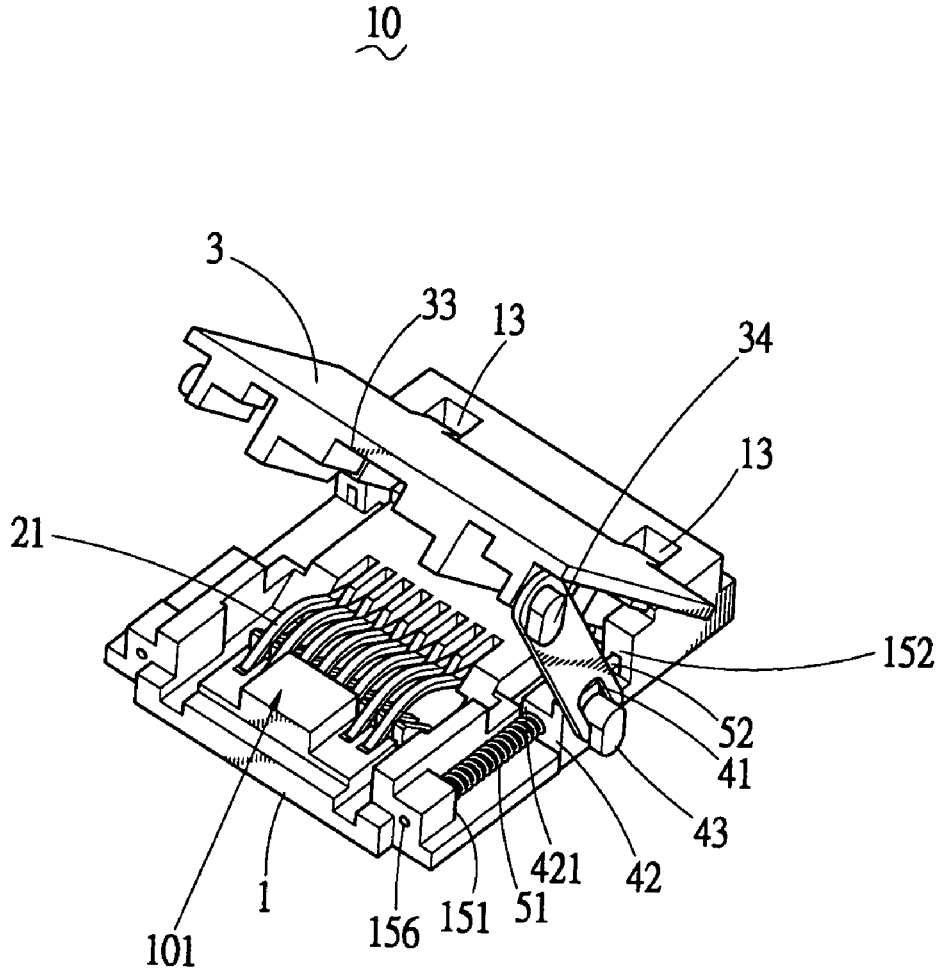
FIG. 2 is an assembled perspective view of the open/close type electrical connector according to the present invention in open position.
Figure 3:
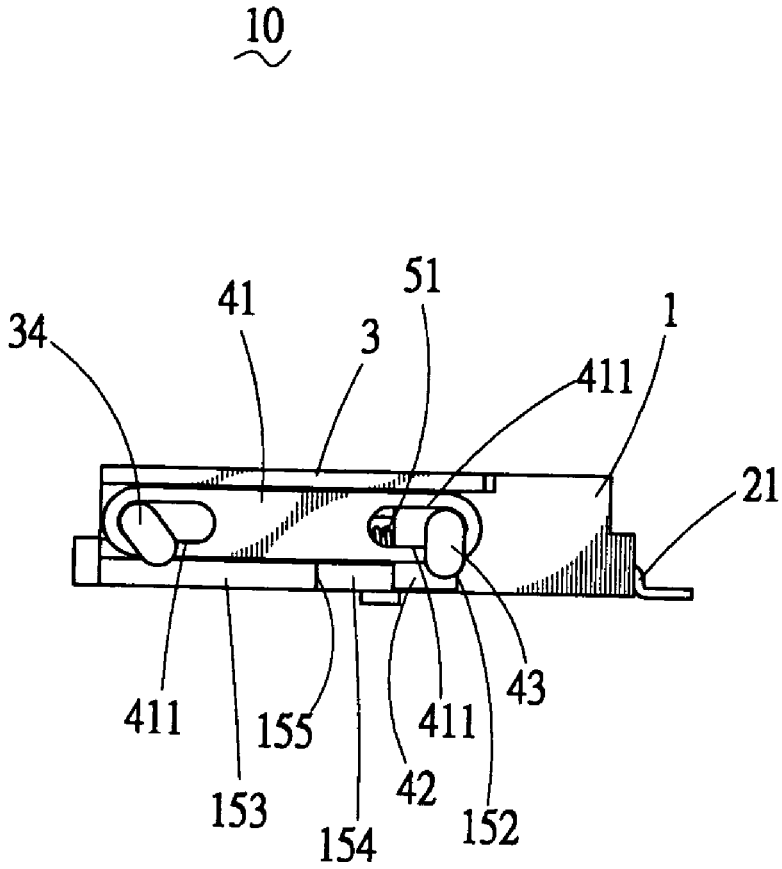
FIG. 3 is a perspective view of the open/close type electrical connector according to the present invention in close position.

Referring to FIGS. 2, 3, and 4, as the electrical connector 10 is assembling, the contacting terminals 21 are integrated with the terminal receiving member 22 to form the terminal modular member 2 as shown in FIG. 1 by insert molding technology. Then the terminal modular member 2 is installed in the base member 1 so that the terminal receiving member 22 is fixed on the bottom of the base member 1 and the contacting terminals 21 respectively insert into the corresponding terminal channels 12. Then, the cover member 3 is mounted on the base member 1, with each protrusion member 31 thereof being inserted into the corresponding pivot groove 13 of the base member 1 and pivotally connected with the pivot axis 14 of the base member 1.

And then, the sliding member 42 of the restricting mechanism 4 is installed on the receiving member 15 of the base member 1. The projection member 421 of the sliding member 42 is limited between the rear wall 152 and the stop wall 155. The axis rod 52 passes through the through aperture 422 of the projection member 421 and the elastic mechanism 51 sequentially. And the two ends of the axis rod 52 are respectively located in the axes apertures 156, 157 of the receiving member 15. The elastic mechanism 51 is set on the axis rod 52, with one end thereof withstanding the front wall 151 of the receiving member 15 and the other end withstanding the projection member 421 of the sliding member 42. Finally, the two pivot cavities 411 of the connecting rod 41 are respectively pivotally connected with the protruding axes 34, 43 of the cover member 3 and the sliding member 42. Accordingly, the electrical connector 10 is assembled completely. The cover member 3 can be selected to be in opened position (as shown in FIG. 2) or to be in closed position (as shown in FIG. 3). When the cover member 3 is opened, between the cover member 3 and the base member 1 forms the receiving space 101 to receive the mated modular plug 20.

Figure 5:
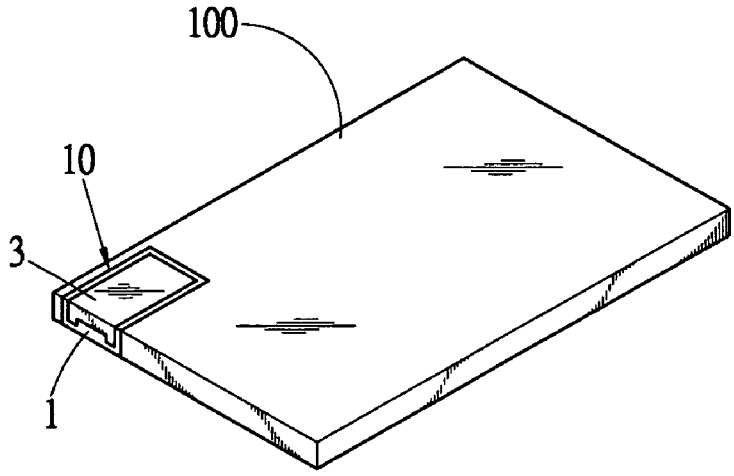
FIG. 5 is a perspective view showing the open/close type electrical connector being used in a computer memory card.
Figure 6:
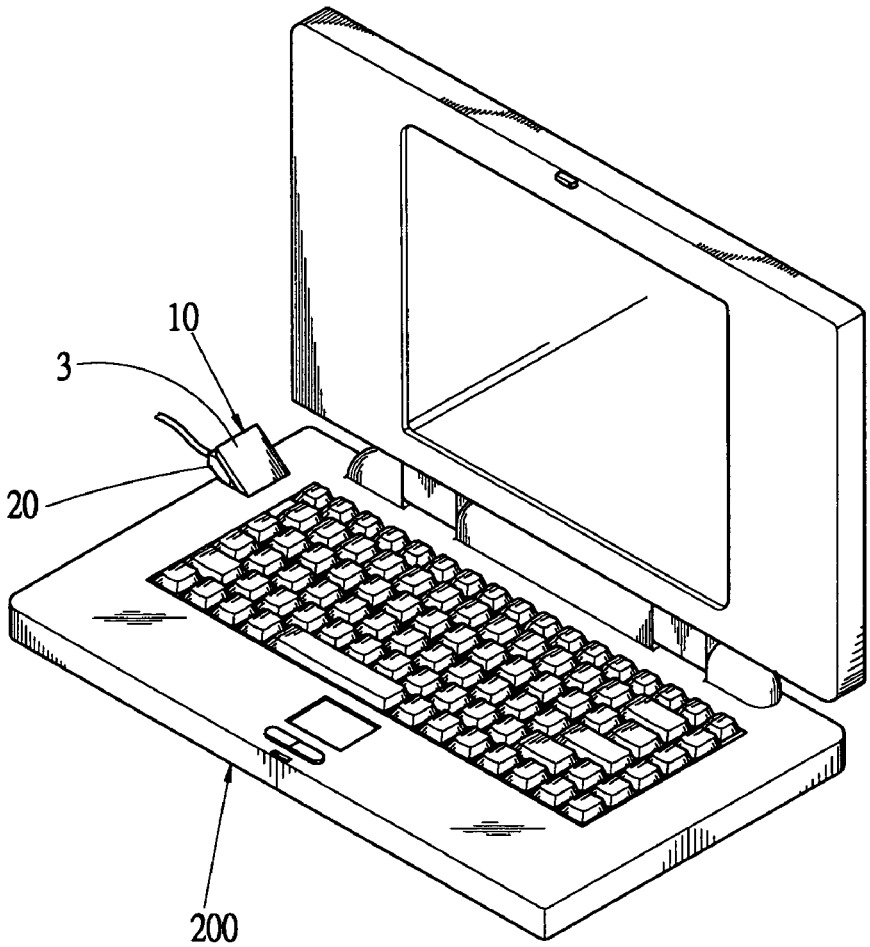
FIG. 6 is a perspective view showing the open/close type electrical connector being used in a portable computer.

Referring to FIG. 5, according to the preferred embodiment, the electrical connector 10 is used for a computer memory card 100 (PCMCIA card) to communicate data signals. When the computer memory card 100 is not used, the cover member 3 is closed, and the top surface of the cover member 3 is flush with the top surface of the computer memory card 100. Therefore, the computer memory card 100 is small thin and convenient for users to carry. In addition, with reference to FIG. 6, the electrical connector 10 is used to a portable computer 200. Because the electrical connector 10 has the function of opening position and closing position selection, the electrical connector 10 is freely installed in the portable computer 200 anywhere.

Figure 7:
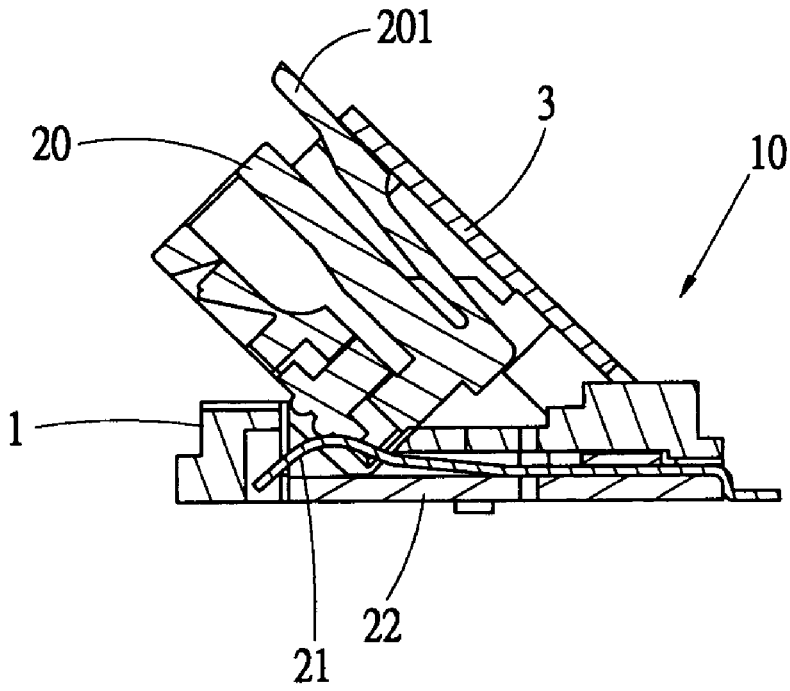
FIG. 7 is a cross-sectional view showing the open/close type electrical connector connected with a mated modular plug.
Figure 8:
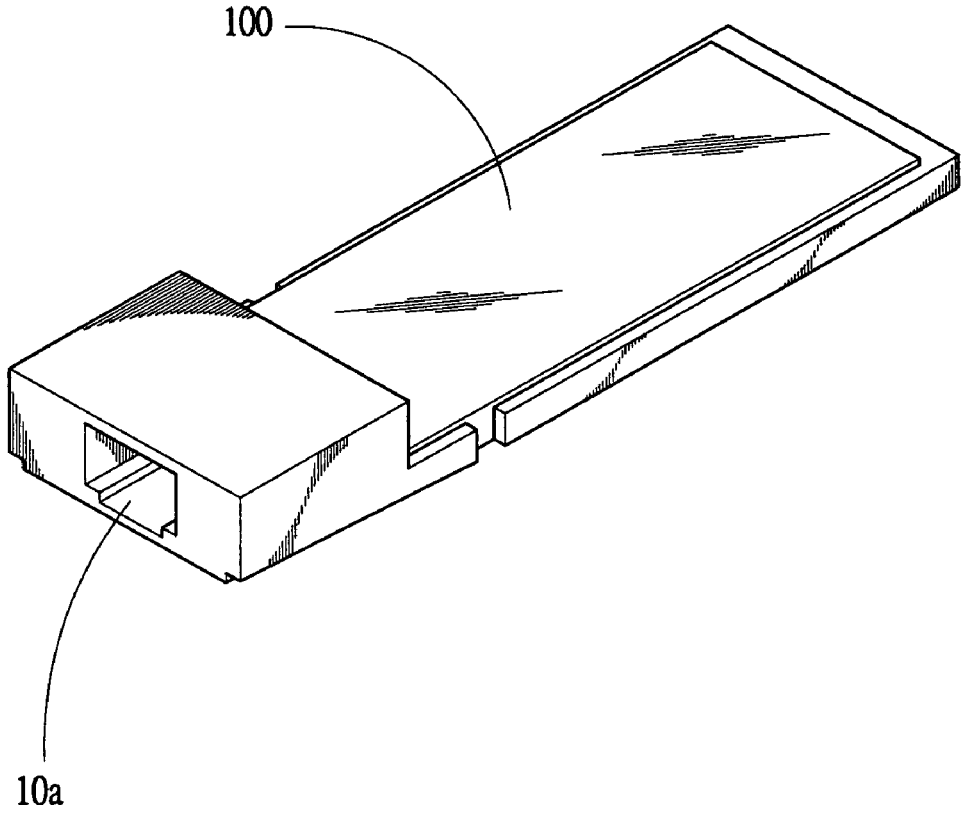
FIG. 8 is perspective view of a standard RJ series electrical connector assembled with a computer memory card according to a prior art.

Referring now to FIG. 3, when the cover member 3 is in close position, the sliding member 42 rests on the rear wall 152 of the receiving member 15. At this time, the elastic mechanism 51 is not pressed completely and has no resilience force to move the sliding member 42. Subsequently, referring to FIGS. 2 and 7, when the mated modular plug 20 engages with the electrical connector 10, the cover member 3 should be lifted upwardly manually, the cover member 3 rotates around the pivot axis 14 at the rear portion of the base member 1. When the cover member 3 rotating, the connecting rod 41 pull the sliding member 42 to slide forward at the same time. While the projection member 421 meets the stop wall 155 of the receiving member 15, the sliding member 42 will stop sliding forward and keep the cover member 3 open in a given angle. And thus, the receiving space 101 is formed between the cover member 3 and the base member 1 for receiving the mated modular plug 20. Therefore, the mated modular plug 20 is sandwiched between the contacting terminals 21 and the cover member 3, and further electrically contacts with the contacting terminals 21 (as shown in FIG. 7) for data communication. Meanwhile, the elastic mechanism 51 should be pressed because of the forward sliding movement of the sliding member 42, so as to store enough resilience force.

When pulling the mated modular plug 20 out of the electrical connector 10, the mated modular plug 20 does not support the cover member 3 anymore. At this time, the stored resilience force of the elastic member 51 is released instantly to push the sliding member 42 backward to the original position. Thereby, the cover member 3 is automatically closed onto the base member 1 through the movement of the connecting rod 41, and the automatic close function is achieved.

As described above, according to the present invention, the cover member 3 of the electrical connector 10 has the function of automatic close manipulation, therefore, the electrical connector 10 is automatically closed to be a small thin member while not used. Furthermore, for the compact structure and small size of the electrical connector 10, it is capable of saving space and convenient for users to carry.

Although a particular embodiment of the invention has been described in detail for purposes of illustration, additional advantages and modifications will readily appear to those skilled in the art, and various modifications and enhancements may be made without departing from the spirit and scope of the invention. Accordingly, the invention is not to be limited except as by the appended claims.

What is claimed is:

1. An open/close type electrical connector comprising:

a base member;

a terminal modular member, installed in the base member to electrically contact with a mated connector;

a cover member disposed on the base member and pivotally connecting with the base member so as to rotate between an opened position and a closed position with respect to the base member, and when the cover member is opened, a receiving space is formed between the cover member and the base member to receive the mated connector;

a restricting mechanism, disposed at a lateral side of the base member and the cover member for restricting the opened angle of the cover member; and an automatic close mechanism, disposed between the base member and the restricting mechanism, to make the cover member automatically close to the base member.

2. The open/close type electrical connector as claimed in claim 1, wherein said terminal modular member comprises a terminal receiving member and a plurality of contacting terminals mounted on the terminal receiving member by way of insert molding.

3. The open/close type electrical connector as claimed in claim 1, wherein said cover member is further provided with two protrusion members protruding outwards therefrom, each protrusion member having a pivot aperture, and correspondingly, two pivot grooves are formed in said base member, each pivot groove has a pivot axis disposed on a lateral wall thereof for pivotally connecting with the corresponding pivot aperture.

4. The open/close type electrical connector as claimed in claim 1, wherein the cover member further forms an indentation groove adapted for engaging with a slice disposed on the mated connector.

5. The open/close type electrical connector as claimed in claim 1, wherein said mated connector is a modular plug.

6. The open/close type electrical connector as claimed in claim 1, wherein said restricting mechanism comprises a connecting rod and a sliding member, with the sliding member disposed on the base member and the connecting rod pivotally disposed between the cover member and the sliding member.

7. The open/close type electrical connector as claimed in claim 6, wherein the connecting rod defines a pivot cavity respectively in both ends thereof for correspondingly holding a protruding axis projected respectively from the sliding member and the cover member.

8. The open/close type electrical connector as claimed in claim 6, wherein the base member defines an elongated receiving member thereon for supporting the sliding member, the receiving member having a front wall and a rear wall disposed respectively at both ends thereof, the outer side of the receiving member protruding to define a shoulder member and a gap member, with a stop wall formed between the shoulder member and the gap member, and the sliding member forming a projection member which is limited to move between the rear wall and the stop wall.

9. The open/close type electrical connector as claimed in claim 8, wherein said automatic close mechanism comprises an elastic mechanism and an axis rod passing through the elastic mechanism, the axis rod further passing through a through aperture defined in the projection member of the sliding member, the two ends of the axes rod respectively located in axes apertures defined respectively in the front wall and the rear wall of the receiving member, one end of the elastic mechanism withstands the front wall, and the other end withstands the projection member of the sliding member.

10. The open/close type electrical connector as claimed in claim 1, wherein said automatic close mechanism comprises an elastic mechanism and an axis rod passing through the elastic mechanism.

11. The open/close type electrical connector as claimed in claim 10, wherein said elastic mechanism is a spring.

* * * * *